US008584876B2

(12) United States Patent
de Cleir

(10) Patent No.: US 8,584,876 B2
(45) Date of Patent: Nov. 19, 2013

(54) FOOD CONTAINERS ADAPTED FOR ACCOMMODATING PRESSURE CHANGES USING SKIP SEALS AND METHODS OF MANUFACTURE

(75) Inventor: Piaras Valdis de Cleir, Tarrytown, NY (US)

(73) Assignee: Kraft Foods Group Brands LLC, Northfield, IL (US)

( * ) Notice: Subject to any disclaimer, the term of this patent is extended or adjusted under 35 U.S.C. 154(b) by 779 days.

(21) Appl. No.: 11/773,829

(22) Filed: Jul. 5, 2007

(65) Prior Publication Data

US 2009/0008392 A1 Jan. 8, 2009

(51) Int. Cl.
*B65D 41/20* (2006.01)
*B65D 51/16* (2006.01)
*B65D 53/04* (2006.01)

(52) U.S. Cl.
USPC ..... 215/310; 215/45; 215/270; 215/349; 220/359.4; 220/785

(58) Field of Classification Search
USPC ..... 215/270, 341, 307, 310, 349, 43–45, 215/260, 311, 313, 314, 902; 220/359.4, 220/785, 203.09, 240, 295, 296, 303–305, 220/366.1, 367.1, 745, 799; 53/478
See application file for complete search history.

(56) References Cited

U.S. PATENT DOCUMENTS 2,138,376 A * 11/1938 Griswold ..... 215/260
2,235,101 A * 3/1941 Enkur ..... 215/260
2,351,150 A * 6/1944 Sanford ..... 215/243
2,353,520 A * 7/1944 Stanley ..... 215/231
2,423,295 A * 7/1947 Crabbe et al. ..... 215/260
2,424,801 A * 7/1947 Crabbe et al. ..... 215/260
2,456,607 A * 12/1948 Shaffer ..... 215/350
2,626,073 A * 1/1953 Miller, Jr. et al. ..... 215/260
2,738,091 A * 3/1956 Mattox ..... 215/260
2,937,481 A * 5/1960 Palmer ..... 53/471
2,965,257 A * 12/1960 Lipman ..... 215/260
3,042,247 A * 7/1962 Bonnet ..... 220/366.1
3,043,463 A * 7/1962 Beall, Jr. ..... 215/260
3,114,467 A * 12/1963 Montgomery ..... 215/260
3,147,876 A * 9/1964 Lepore ..... 215/261
3,181,720 A * 5/1965 Cassie etal. ..... 215/260
3,405,831 A * 10/1968 Hudson ..... 215/330
3,620,400 A * 11/1971 Braun ..... 215/330
3,625,348 A * 12/1971 Titchenal et al. ..... 206/484

(Continued)

FOREIGN PATENT DOCUMENTS

EP 0 149 198 A2 7/1985
EP 0718206 A1 6/2006

(Continued)

*Primary Examiner* — J. Gregory Pickett
*Assistant Examiner* — Ned A Walker
(74) *Attorney, Agent, or Firm* — Fitch, Even, Tabin & Flannery LLP

(57) ABSTRACT

A food container is disclosed that is adapted for facilitating venting of gasses to and/or from the interior of a body of the food container. The food container includes a container body, a lid and a sealing membrane. At least one skip seal or gap is formed between the sealing membrane and the container body to facilitate venting. During formation of the at least one skip seal a recess in either the lid or rim of the container reduces pressure at the skip seal to reduce or eliminate inadvertent closing of the skip seal.

21 Claims, 7 Drawing Sheets

(56) References Cited

U.S. PATENT DOCUMENTS

| | | | | | |
|---|---|---|---|---|---|
| 3,632,004 | A | * | 1/1972 | Grimes et al. | 215/232 |
| 3,741,421 | A | * | 6/1973 | Wittwer | 215/217 |
| 3,888,347 | A | * | 6/1975 | Kramer | 206/315.9 |
| 4,007,848 | A | * | 2/1977 | Snyder | 215/44 |
| 4,007,851 | A | * | 2/1977 | Walker | 215/307 |
| 4,066,181 | A | * | 1/1978 | Robinson et al. | 215/256 |
| 4,089,434 | A | * | 5/1978 | Tagalakis et al. | 215/260 |
| 4,121,728 | A | * | 10/1978 | Tagalakis et al. | 215/260 |
| 4,130,222 | A | * | 12/1978 | Ono | 220/373 |
| 4,382,521 | A | * | 5/1983 | Ostrowsky | 215/307 |
| 4,392,055 | A | * | 7/1983 | Whitney | 215/307 |
| 4,427,126 | A | * | 1/1984 | Ostrowsky | 215/307 |
| 4,657,221 | A | | 4/1987 | Urmston et al. | |
| 4,674,643 | A | | 6/1987 | Wilde et al. | |
| 4,684,554 | A | | 8/1987 | Ou-Yang | |
| 4,738,370 | A | * | 4/1988 | Urmston et al. | 215/307 |
| 4,747,500 | A | * | 5/1988 | Gach et al. | 215/250 |
| 4,747,502 | A | * | 5/1988 | Luenser | 215/307 |
| 4,993,572 | A | * | 2/1991 | Ochs | 215/260 |
| 5,024,345 | A | * | 6/1991 | Deweerdt | 220/366.1 |
| 5,078,290 | A | * | 1/1992 | Ochs | 215/276 |
| 5,356,021 | A | * | 10/1994 | McBride et al. | 215/349 |
| 5,366,774 | A | * | 11/1994 | Pinto et al. | 428/36.92 |
| 5,397,024 | A | * | 3/1995 | Wu et al. | 220/231 |
| 5,460,282 | A | | 10/1995 | Giblin et al. | |
| 5,462,186 | A | | 10/1995 | Ladina et al. | |
| 5,465,864 | A | * | 11/1995 | McClean | 220/495.08 |
| 5,564,582 | A | * | 10/1996 | Kamath | 215/252 |
| 5,579,936 | A | * | 12/1996 | Costa et al. | 215/261 |
| 5,676,269 | A | | 10/1997 | Blake et al. | |
| 5,730,306 | A | * | 3/1998 | Costa et al. | 215/261 |
| 5,746,337 | A | | 5/1998 | Haist | |
| 5,762,217 | A | * | 6/1998 | Ohmi et al. | 215/253 |
| 5,839,592 | A | * | 11/1998 | Hayes | 215/230 |
| 5,984,124 | A | * | 11/1999 | Takano | 215/252 |
| 6,123,212 | A | | 9/2000 | Russell et al. | |
| 6,202,870 | B1 | * | 3/2001 | Pearce | 215/307 |
| 6,202,871 | B1 | * | 3/2001 | Kelly | 215/307 |
| 6,234,338 | B1 | | 5/2001 | Searle | |
| 6,299,006 | B1 | * | 10/2001 | Samonek | 215/307 |
| 6,502,710 | B1 | * | 1/2003 | Bosl et al. | 215/351 |
| 6,602,309 | B2 | * | 8/2003 | Vizulis et al. | 55/385.4 |
| 6,659,297 | B2 | * | 12/2003 | Gregory et al. | 215/252 |
| 6,948,630 | B2 | * | 9/2005 | Julian et al. | 215/43 |
| 7,048,140 | B1 | * | 5/2006 | Caldwell | 220/371 |
| 7,097,056 | B2 | * | 8/2006 | Ozawa et al. | 215/44 |
| 7,419,066 | B1 | * | 9/2008 | Ewers | 220/303 |
| 7,611,026 | B1 | * | 11/2009 | Bloom et al. | 215/276 |
| 7,766,178 | B2 | * | 8/2010 | Robinson et al. | 215/349 |
| 2003/0234254 | A1 | * | 12/2003 | Grybush et al. | 220/366.1 |
| 2004/0055992 | A1 | * | 3/2004 | Robinson et al. | 215/347 |
| 2007/0181525 | A1 | * | 8/2007 | Gregory et al. | 215/252 |

FOREIGN PATENT DOCUMENTS

| | | | |
|---|---|---|---|
| JP | 8-34455 | A | 2/1996 |
| JP | 9-328158 | A | 12/1997 |
| WO | 96/13443 | A1 | 5/1996 |
| WO | 96/29257 | A1 | 9/1996 |
| WO | 97/26941 | A1 | 7/1997 |
| WO | 2004/005153 | A1 | 1/2004 |

* cited by examiner

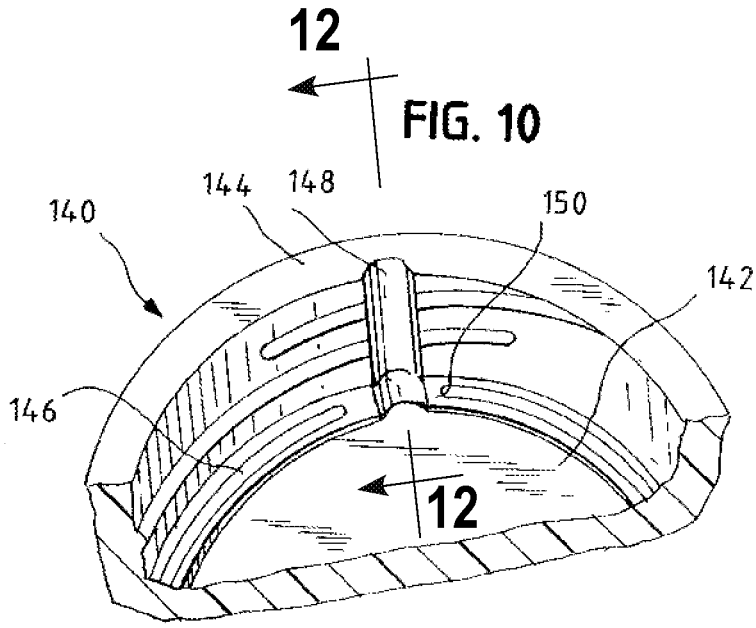
FIG. 10
FIG. 11
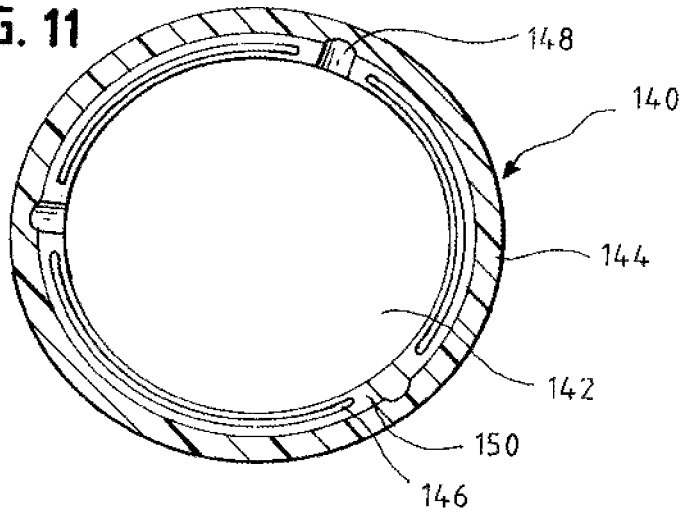

FOOD CONTAINERS ADAPTED FOR ACCOMMODATING PRESSURE CHANGES USING SKIP SEALS AND METHODS OF MANUFACTURE

FIELD

Food containers are disclosed that are adapted for accommodating pressure changes, as well as methods of manufacturing the same. In particular, food containers are disclosed that have a sealing membrane sealed to a container rim with gaps in the seal for venting from and to the container.

BACKGROUND

One type of food container has a container body with an interior defined by a bottom wall, an upstanding sidewall and an open upper end. The open upper end may have a neck, such as with external threading, and an upward facing rim. A tamper evident member or sealing member can be sealed to the rim to cover the open upper end of the container body and, in some circumstances, to provide a visual indication of tamper evidence. A lid can be placed over the sealing membrane, and can have a closure wall with a depending skirt. The skirt may have an internal thread for mating with the external threads of the neck of the container body.

If the sealing membrane is completely sealed to the rim, then any gasses present or generated within the interior of the container body can cause the sidewall of the container to deform. This can be particularly the case when a food container is shipped across high altitudes, such as by crossing over high mountains. In addition to deformation due to expansion, the container body can also deform inwardly if there is a reduction in pressure in the interior of the container body as compared to exterior of the container. Deformation of the container body is undesirable, and can result in containers having visually unappealing appearances. Deformation, if sufficient, can also rupture the sealing membrane from the rim, resulting in a product that can appear to have been tampered with.

To address the problems associated with deformation of the container body, in the past skip seals have been made between the sealing membrane and the rim of the container body. A skip seal is a small gap in the sealing between the sealing membrane and the rim of the container body that is configured to permit gasses to enter and leave the interior of the container body.

One way of attaching the sealing membrane to the rim of the container body is by using induction heating. In induction heating, pressure is applied on a surface of the sealing membrane urging the sealing membrane against the rim of the container body. The pressure can be applied using raised or otherwise configured portions of the lid. With pressure applied, the food container is sent through an induction heater, which causes the sealing membrane to seal to the rim of the container in areas where pressure is applied by the lid.

The pressure-applying portion of the lid is supposed to be configured to apply pressure only in certain areas, so that the sealing membrane is not sealed to the entirety of the rim of the container so that skip seals are formed. However, sealing between the sealing membrane and the rim of the container body can inadvertently occur, which can close the skip seals and result in a container body that is completely sealed by the sealing membrane. For example, if the sealing membrane has a size larger than the periphery of the rim of the container body, as is often the case, then edges of the sealing membrane can inadvertently seal to the container rim and close the intended skip seals. In this example, the lid can exert pressure on a portion of the sealing membrane extending past the rim and cause the sealing membrane to seal to the rim or adjacent to the rim, resulting in closed skip seals. Closed skip seals can lead to the undesirable deformations of the container body discussed above.

SUMMARY

A food container is disclosed that is adapted for facilitating venting of gasses to and/or from the interior of a body of the food container. The food container includes a container body, a lid and a sealing membrane. At least one skip seal or gap is formed between the sealing membrane and the container body to facilitate venting. The at least one skip seal is automatically aligned as a result of the pressure sealing process with at least one recess formed in either or both of the lid or the rim of the container body to reduce or eliminate inadvertent closing of the skip seal and thereby facilitate venting from the container body.

The container body may have an interior and an open end surrounded by a neck and having a facing rim. The sealing membrane may be induction-sealed or cold-sealed to the facing rim of the neck of the container body to cover the open end of the container body. The lid of the container may have a closure wall and a depending skirt, the depending skirt being sized to fit around the neck of the container. A sealing gap or skip seal is positioned between the sealing membrane and the facing rim aligned with a recess formed in either or both of the skirt of the lid and the rim of the container to reduce or eliminate inadvertent closing of the sealing gap by relieving pressure between the sealing membrane and the rim of the container body adjacent or at least partially coextensive with the sealing gap.

The closure wall has an inner surface facing the rim of the container body. In one aspect, a raised rib may be disposed on the inner surface about the periphery thereof, the raised rib having a gap therein on an opposite side of the sealing membrane from the sealing gap between the sealing membrane and the facing rim of the container body. In another aspect, the inner surface of the lid may have a channel or other depression intersecting the periphery of the inner surface. During induction or cold sealing, the raised rib or periphery may exert pressure on the sealing membrane to seal the sealing membrane to the rim of the container body. The recess of the lid can be aligned with the sealing gap so that the lid does not exert pressure adjacent the sealing gap during formation of the sealing gap sufficient to inadvertently form a closed sealing gap. In yet another aspect, a recess can be formed in the rim of the container body to relieve pressure during the sealing process adjacent the sealing gap to reduce or eliminate inadvertent closing of the sealing gap. That is, the recess may be formed in the facing portion of the rim and/or in a radially outward facing portion of the rim below the face. In another aspect, aligned recesses may be provided in both the lid and the rim of the container to further reduce or eliminate pressure adjacent the sealing gap.

A method of covering an open end of a food container with a sealing membrane is also disclosed. The method includes positioning the sealing membrane between a lid and a rim surrounding the open end of the food container. The method also includes induction sealing or cold sealing the sealing membrane to the rim of the food container with one or more sealing gaps positioned between the rim of the food container and the sealing membrane to permit venting between the rim and the sealing membrane. The method further includes aligning one or more recesses formed in either or both of an inward surface of a skirt of the lid or the rim of the container body with the one or more sealing gaps as a result of the pressure sealing process to relieve pressure between the lid, the sealing membrane and the rim of the container body to reduce or eliminate inadvertent closing of the sealing gaps.

BRIEF DESCRIPTION OF THE DRAWINGS

FIG. 10 is a partial perspective view of the underside of another embodiment of a lid showing recesses in a skirt of the lid;

FIG. 11 is a plan view of the underside of the lid of FIG. 8 showing the recesses in the skirt of the lid;

DETAILED DESCRIPTION OF THE DRAWINGS

Figure 1:
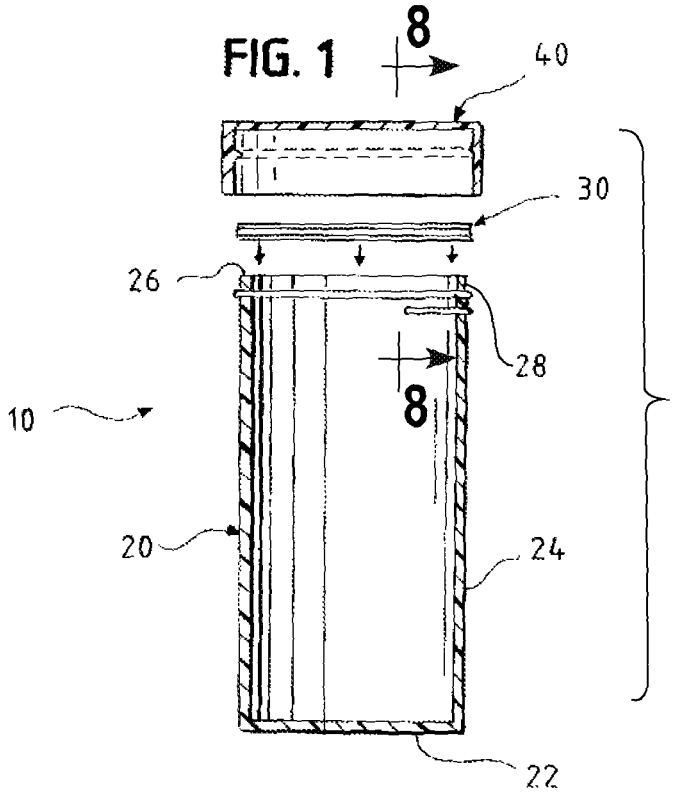
FIG. 1 is an exploded side elevation cross-sectional view of a food container with a sealing membrane and a lid.

A food container is described and illustrated in FIGS. 1-16 that is adapted for facilitating venting of gasses to and/or from the interior of a body of the food container. The food container 10 includes a container body 20, a lid 40 and a sealing membrane 30 that is induction sealed or cold sealed to a rim 26 of the container body 20, as illustrated in FIG. 1. At least one skip seal or gap 52 is formed between the sealing membrane 30 and the rim 26 of the container body 20 to facilitate venting. The skip seal 52 is aligned with a recess 48 formed in the lid to relieve pressure between the lid 40, the sealing membrane 30 and the container body 20 during the pressure sealing operation to reduce or eliminate inadvertent closing of the gap 52 between the sealing membrane 30 and the container body 20.

Figure 2:
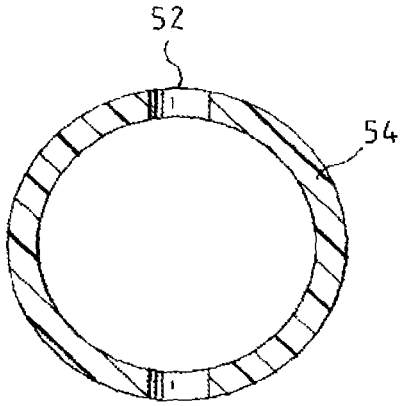
FIG. 2 is a view of the ideal sealing between the sealing membrane and a rim of the food container of FIG. 1 showing open sealing gaps.
Figure 3:
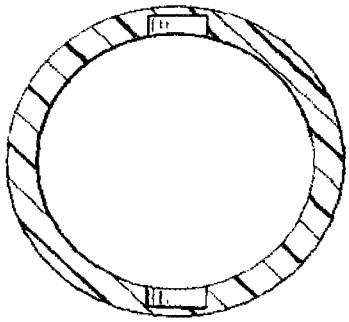
FIG. 3 PRIOR ART
FIG. 3 is a view of a sealing in the prior art that can occur between the sealing membrane and the rim of the food container of FIG. 1 showing closed sealing gaps.

The container body 20 includes a bottom wall 22, an upstanding sidewall 24 and a neck 28. The neck 28 includes a facing rim 26 to which the sealing membrane 30 is adhered. In order to seal the sealing membrane 30 to the rim 26 of the container body 30, pressure is applied on an opposite side of the sealing membrane 30 using the lid 40. The pressure is applied at locations where sealing of the sealing membrane 30 to the lid 40 is desired, such as seal areas 54. In order to make the skip seals or gaps 52, features on the underside of the lid 40 are configured to not apply the same degree of pressure as is applied in the seal areas 54 where sealing is desired. Although in some circumstances the gaps 52 are open as a result of this sealing process, as illustrated in FIG. 2, in other circumstances, gaps can be closed using prior art lids, as illustrated in FIG. 3. Circumstances which result in the gaps 52 being closed can include where the size of the sealing membrane 30 is larger than the perimeter of the rim 26, and can result in pressure from a sidewall portion of a prior art the lid to cause localized sealing. Other circumstances are believed to arise due to typical variations due to manufacturing tolerances, such as if the sealing membrane 30 is off-center or otherwise misaligned with the rim 26.

Figure 4:
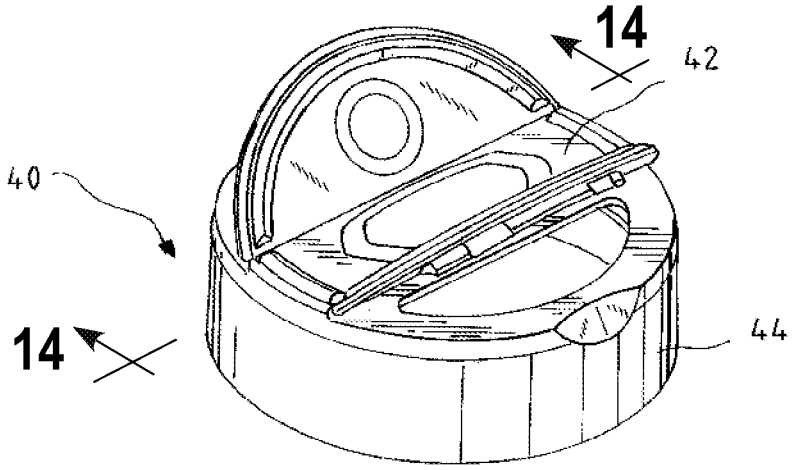
FIG. 4 is a perspective view of a lid for the food container of FIG. 1.
Figure 6:
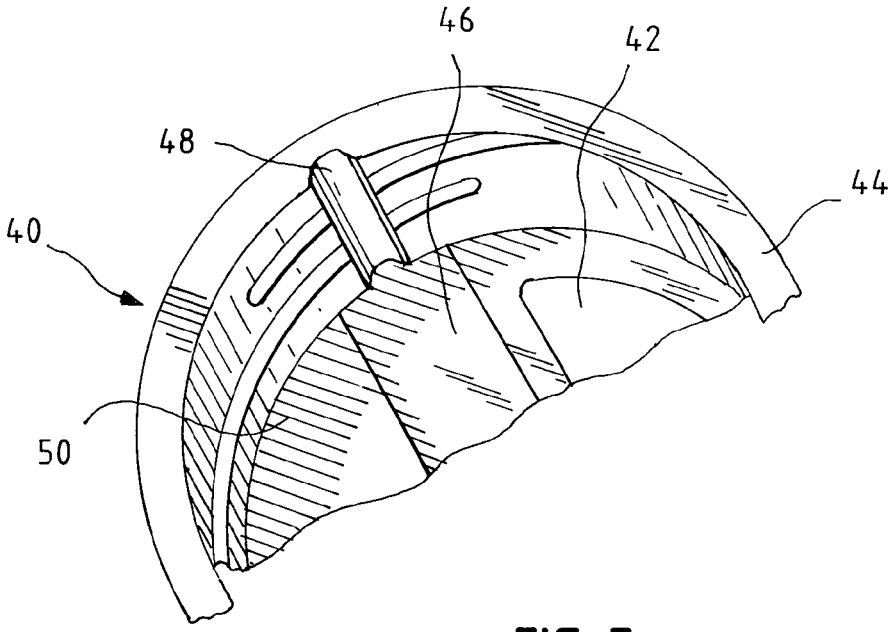
FIG. 6 is a partial perspective view of the underside of the lid of FIG. 4 showing recesses in a skirt of the lid.
Figure 7:
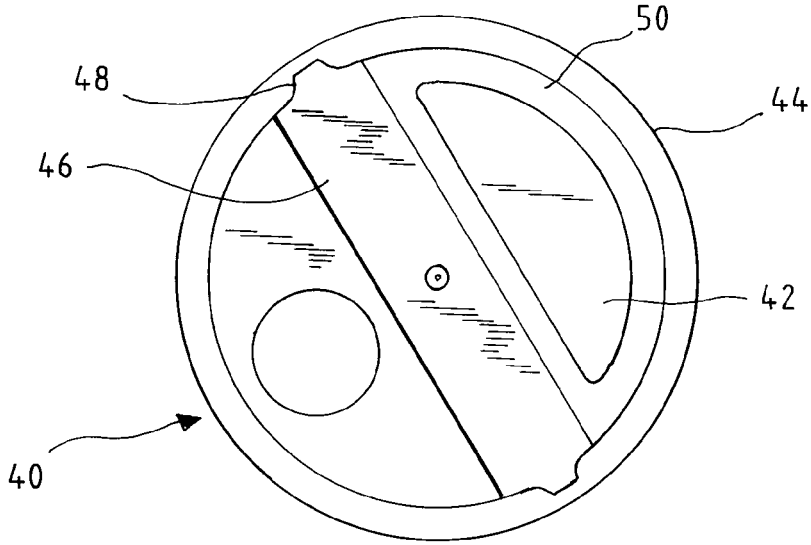
FIG. 7 is a plan view of the underside of the lid of FIG. 4 showing the recesses in the skirt of the lid.
Figure 8:
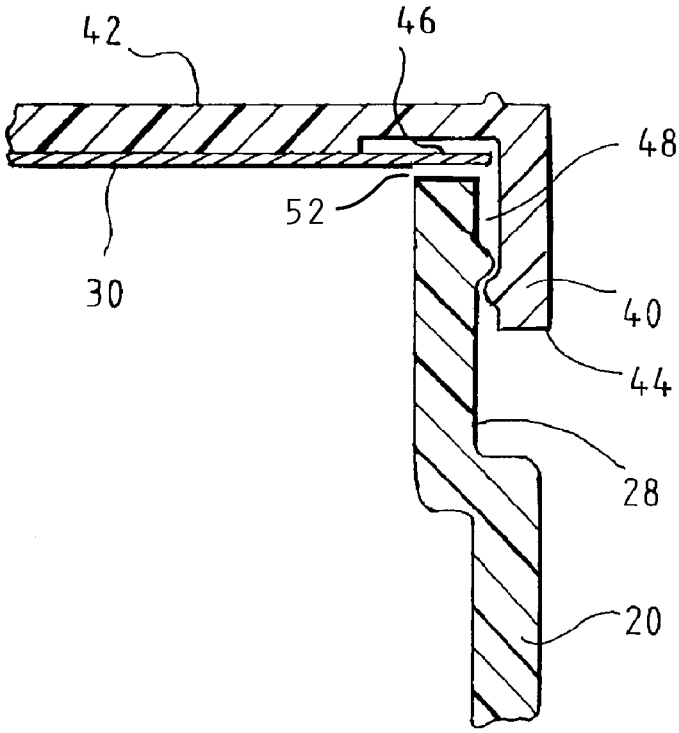
FIG. 8 is a partial sectional view of the lid with recess of FIG. 4 assembled with the sealing membrane and the container body.
Figure 9:
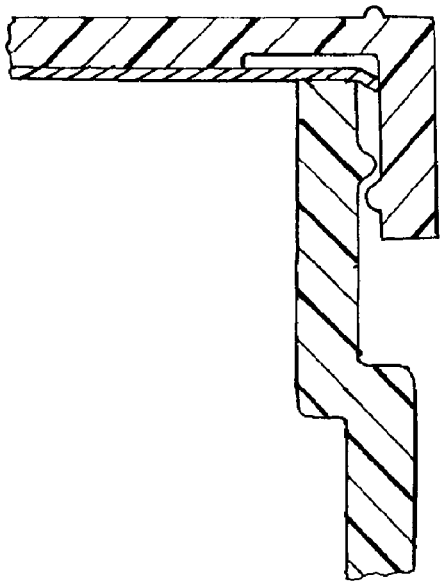
FIG. 9 PRIOR ART
FIG. 9 is a partial sectional view similar to FIG. 8 but showing a prior art lid without a recess.
Figure 14:
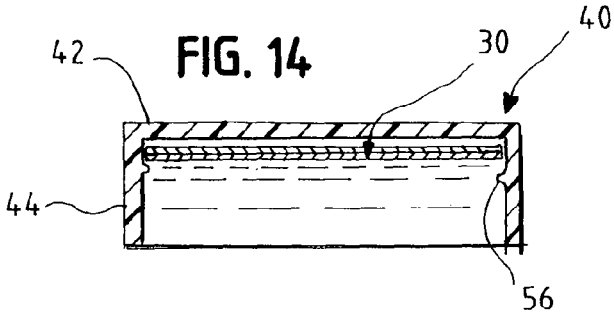
FIG. 14 is a sectional view of the lid of FIG. 4 carrying the sealing membrane.
Figure 15:
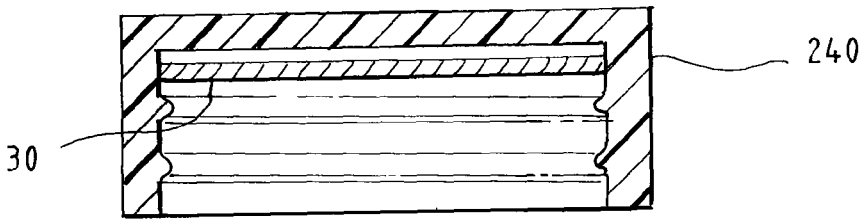
FIG. 15 is a cross sectional view of a lid without recesses and a sealing membrane for use with a container body having recesses on the rim thereof.

Turning now to an embodiment of the lid 40, illustrated in FIGS. 4, 6-8 and 10, the lid 40 includes a closure wall 42 with the skirt 44 depending about the periphery thereof. The lid 40 may have one or more hinged portions to permit access to the contents of the food container 10 without requiring removal of the lid 40 from the neck 28 of the container body 20, as illustrated in FIG. 4. The inwardly facing side of the skirt 44 may have a plurality of projections 56 for retaining the sealing membrane 30 prior to induction sealing or cold sealing, as illustrated in FIG. 14. The lid 40 may have threads for mating with threads formed on the neck 28 of the container body 20. The underside of the closure wall 42 of the lid 40 has a channel 46 extending along a diameter of the wall 42 from one side of the skirt 44 to the other, as illustrated in FIGS. 6 and 7. On either side of the channel is a comparatively raised periphery 50. During induction sealing or cold sealing, the raised periphery 50 of the underside of the wall 42 exerts pressure against the sealing membrane 30 to urge the sealing membrane 30 against the rim 26 of the container body 20 so that the seal areas 54 are formed. The locations where the channel 46 intersects the sidewall 44 form the gaps 52 in the sealing of the sealing membrane 30 to the rim 26 of the container body 20. The recesses 48 in the sidewall 44 of the lid 40 are aligned with the channel 46 to relieve pressure at that location between the lid 40, the sealing membrane 30 and the rim 26 to reduce or eliminate inadvertent closing of the gaps 52 during the pressure sealing process, such as illustrated in FIG. 8. The recesses 48 can be an area of reduced or thinned cross section in the sidewall 44 of the lid, and can have any suitable shape that facilitates pressure relief. The recesses 48 may, but are not required, extend the length of the sidewall 44 to function as a vent path. In contrast, a prior art lid without the recesses 48, illustrated in FIG. 9, has a sidewall of the lid that can exert pressure against an overhanging portion of a sealing membrane during the pressure sealing process to inadvertently cause closing of the sealing gap and thereby prevent venting.

Figure 12:
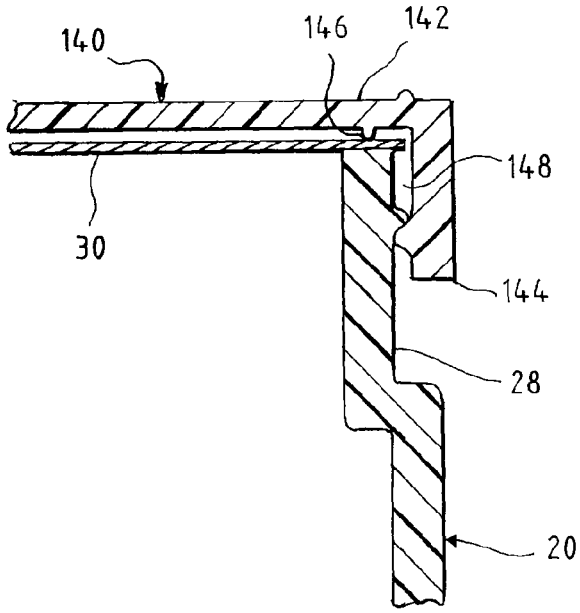
FIG. 12 is a partial sectional view of the lid with recess of FIG. 10 assembled with the sealing membrane and the container body.
Figure 13:
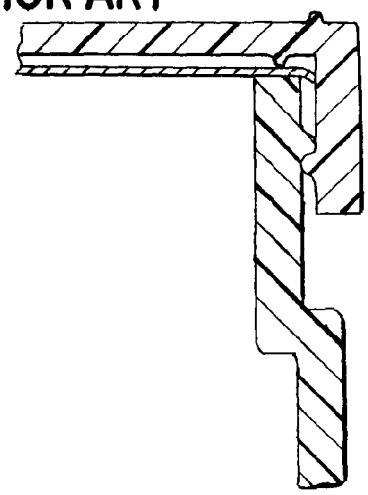
FIG. 13 PRIOR ART
FIG. 13 is a partial sectional view similar to FIG. 12 but showing a prior art lid without a recess.

Turning now to another embodiment of a lid 140, illustrated in FIGS. 10-12, the lid 140 includes a closure wall 142 and a depending skirt 144. On the underside of the wall 142 is a raised rib 146 disposed on a raised periphery 150. The raised rib 146 has a plurality of segments spaced by gaps. The raised rib 146 is configured to exert pressure against the sealing membrane 30 urging the sealing membrane 30 against the rim 26 of the container body 20 during induction sealing or cold sealing. The gaps between the segments of the rib 146 are configured to result in the sealing gaps 52 in the seal area 54 of the sealing membrane 30 to the rim 26 of the container body 20. Recesses 148 extend along the height of the sidewall 144, as illustrated in FIG. 10, and also include a segment through the periphery 150 and through the gaps in the rib 146. The recesses 148 provide a pressure relief between the lid 40, the sealing membrane 30 and the rim 26 of the container body 20 to reduce or eliminate closing of the sealing gaps 52 during the pressure sealing process, as illustrated in FIG. 12. In contrast, a prior art lid lacking the recess 148, illustrated in FIG. 13, has a sidewall that can exert pressure adjacent the sealing gap to inadvertently close the sealing gap and prevent venting.

Figure 5:
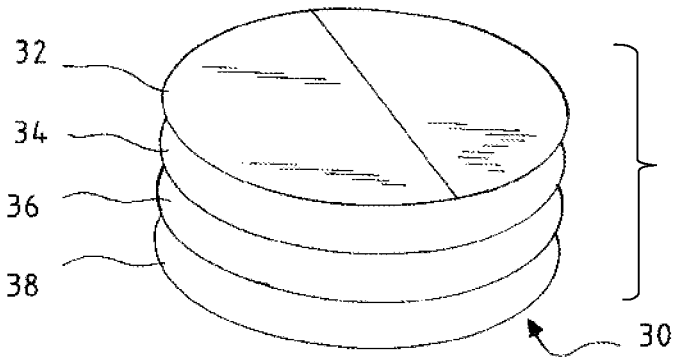
FIG. 5 is an exploded perspective view of the sealing membrane of FIG. 1.

The sealing membrane 30 may be a laminate suitable for induction sealing or cold sealing. As illustrated in FIG. 5, one example is a laminate that has a top layer 32 of a polyethylene film, a layer 34 of a polyethylene foam, layer of foil 36 and a layer 38 of heat sealable polyethylene for sealing to the rim 26 of the container body 20. A suitable laminate called LIFT'N'PEEL™ is available from UNIPAC, Aurora, Ontario, Canada, under product number ISCT-U5. The top layer 32 may have a segment unattached or easily removable from the adjacent layer top provide a pull tab for facilitating removal of the sealing membrane 30 from the container body 20. For an induction sealing process, suitable induction sealers are made by Enercon Industries, Menomonee Falls, Wis.

To manufacture food containers 10 described herein, the body 20 can be filled with a food product, such as a grated cheese. The sealing membrane 30 can be inserted into the underside of the lid 40 and retained by the projections 56. The lid 40 can be secured to the neck 28 of the container body 20, such as with threads, to position the sealing membrane 30 on the rim 26 of the container body 20. Formations on the underside of the lid 40 or 140, such as raised ribs 146 or a raised periphery 50, exert pressure on the sealing membrane 30 against the rim 26 in sealing areas 54. The food container 10 is passed through an induction sealing unit to heat the sealing layer 38 of the sealing membrane 30 and adhere the sealing membrane 30 to the rim 26 of the container body 20 in the sealing areas 54 to form sealing gaps 52 to permit venting. To relieve pressure at the sealing gaps 52, recesses 48 or 148 in the lid 40 or 140 are aligned with the sealing gaps 52 to reduce pressure between the lid 40 or 140, the sealing membrane 30 and the rim 26 of the container body 26 during the pressure sealing process to reduce or eliminate inadvertent sealing of the gaps 52.

Figure 16:
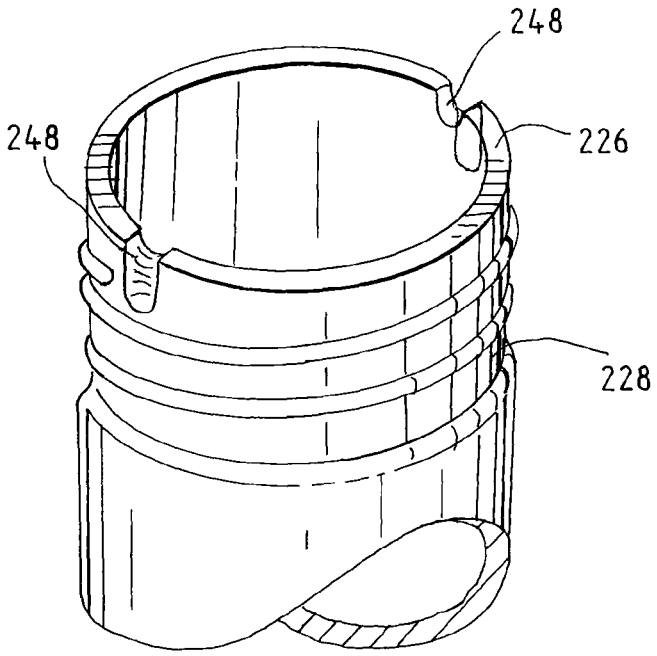
FIG. 16 is a partial perspective view of a container body having recesses on the rim thereof for use with the lid of FIG. 4 or 15.

Although the recesses 48 or 148 may be formed in the lid 40 or 140, recesses 248 may instead or in addition be formed on the rim 226 of a container neck 228, as illustrated in FIG. 16. A conventional lid 240, illustrated in FIG. 15, may be used or a lid with recesses may be used with the recesses 248 in the container neck 228. The recesses 248 may extend only in a face of the rim 226, or may extend both in the face of the rim 226 and along the radially-outward side of the rim 226, as illustrated in FIG. 16. The recesses 248 are aligned with the sealing gaps 52 to reduce pressure adjacent the sealing gaps 52 and thereby reduce or eliminate inadvertent closing of the sealing gaps 52.

The drawings and the foregoing descriptions are not intended to represent the only forms of the food containers in regard to the details of construction and methods of manufacture. Changes in form and in the proportion of parts, as well as the substitution of equivalents, are contemplated as circumstances may suggest or render expedient; and although specific terms have been employed, they are intended in a generic and descriptive sense only and not for the purposes of limitation.

The invention claimed is:

1. A food product container comprising:

a container body comprising an interior, an exterior, and a neck having an open end defined by a rim, the rim having an uppermost edge defined by a radial thickness;

a lid of the container having a top closure wall and a depending skirt, the depending skirt being sized to fit around the neck of the container;

a sealing membrane having an upper surface, an outer external edge, and a lower surface being induction-sealed to the rim of the neck of the container body to cover the open end of the container body;

a radial sealing gap extending between the uppermost edge of the rim and of the lower surface of the sealing membrane, the radial sealing gap extending continuously along the radial thickness of the rim to permit an exchanging of gasses between the interior of the container body and the exterior of the container body;

a first axial recess formed in the skirt of the lid and extending proximate the outer external edge of the sealing membrane, the radial sealing gap aligned and communicating with the axial recess to relieve pressure between the sealing membrane, the lid, and the rim;

wherein the top closure wall of the lid has an inner surface facing the rim of the neck of the container body and a channel is radially disposed on the inner surface, the channel facing the upper surface of the sealing membrane and being on an opposite side of the sealing membrane from the sealing gap between the sealing membrane and the rim of the neck of the container body; and wherein the first recess is aligned with the channel.

2. The food product container of claim 1, wherein the top closure wall has an inner surface facing the rim of the container body and a raised rib is disposed on the inner surface about the periphery of the inner surface, the raised rib having a gap on an opposite side of the sealing membrane from the sealing gap between the sealing membrane and the facing rim of the container body.

3. The food product container of claim 2, wherein the first recess is aligned with the gap of the raised rib.

4. The food product container of claim 1, wherein a recess is formed in the rim of the container body and is aligned with the sealing gap.

5. The food product container of claim 2, wherein the sealing membrane is a laminate having a layer of heat sealable material facing the rim of the container.

6. The food product container of claim 2, wherein a plurality of sealing gaps and a plurality of recesses are provided.

7. The food product container of claim 1, wherein the channel extends along a diameter of the inner surface of the top closure wall.

8. The food product container of claim 1, wherein a second recess is formed in the rim of the container body and adjacent the first recess.

9. The food product container of claim 1, wherein the sealing membrane is a laminate having a layer of heat sealable material facing the rim of the container.

10. The food product container of claim 1, wherein a second recess is aligned with the sealing gap to relieve pressure between the sealing membrane, the lid and the rim.

11. The food product container of claim 1, wherein the sealing membrane is spaced from the skirt of the lid by the first recess.

12. The food product container of claim 1, wherein the skirt of the lid is provided with a second recess aligned with the channel and located opposite the first recess.

13. The food product container of claim 8, wherein the second recess extends downwardly along a radially-outward side of the rim.

14. The food product container of claim 1, wherein the channel spans from one side of the skirt to an opposite side of the skirt.

15. The food product container of claim 1, wherein the channel extends partially inwardly from the skirt.

16. The food product container of claim 2, wherein the channel extends partially inwardly from the skirt and through the gap of the raised rib.

17. The food product container of claim 12, wherein the channel is a common channel that extends between the first and second recesses.

18. The food product container of claim 1, wherein the channel is linear.

19. The food product container of claim 1, wherein the sealing membrane is planar.

20. A food product container comprising:

a container body comprising an interior, an exterior, and a neck having an open end with a rim, the rim having a radial thickness;

a lid of the container having a closure wall and a depending skirt, the depending skirt being sized to fit around the neck of the container;

a sealing membrane induction-sealed to the rim of the neck of the container body to cover the open end of the container body;

a sealing gap positioned between the sealing membrane and the rim, the sealing gap extending continuously along the radial thickness of the rim to permit an exchanging of gasses between the interior and the exterior of the container body, the sealing gap aligned and communicating with a first recess and a second recess formed in the skirt of the lid to relieve pressure between the sealing membrane, the lid, and the rim, and the sealing membrane being radially spaced from the skirt of the lid by the first recess;

wherein the closure wall has an inner surface facing the rim of the neck of the container body and a channel is disposed on the inner surface, the channel being on an opposite side of the sealing membrane from the sealing gap between the sealing membrane and the rim of the neck of the container body; and wherein the first recess is aligned with the channel and the second recess is aligned with the channel and located opposite the first recess.

21. A food product container comprising:

a container body comprising an interior, an exterior, and a neck having an open end with a rim, the rim having a radial thickness;

a lid of the container having a closure wall and a depending skirt, the depending skirt being sized to fit around the neck of the container;

a sealing membrane induction-sealed to the rim of the neck of the container body to cover the open end of the container body;

a sealing gap positioned between the sealing membrane and the rim, the sealing gap extending continuously along the radial thickness of the rim to permit an exchanging of gasses between the interior and the exterior of the container body, the sealing gap aligned and communicating with a first recess formed in the skirt of the lid to relieve pressure between the sealing membrane, the lid, and the rim, and a second recess being formed in the rim of the neck of the container body and positioned proximate the first recess, the second recess extending downwardly along a radially-outward side of the neck;

wherein the closure wall has an inner surface facing the rim of the neck of the container body and a channel is disposed on the inner surface, the channel being on an opposite side of the sealing membrane from the sealing gap between the sealing membrane and the rim of the neck of the container body; and wherein the first recess is aligned and communicating with the channel.

* * * * *

UNITED STATES PATENT AND TRADEMARK OFFICE

CERTIFICATE OF CORRECTION

PATENT NO. : 8,584,876 B2
APPLICATION NO. : 11/773829
DATED : November 19, 2013
INVENTOR(S) : Valdis De Cleir It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 905 days.

Signed and Sealed this
Seventh Day of April, 2015

Michelle K. Lee

Michelle K. Lee
*Director of the United States Patent and Trademark Office*